United States Patent [19]

Genova et al.

[11] Patent Number: 4,497,533

[45] Date of Patent: Feb. 5, 1985

[54] SHIELDED CABLE SYSTEM AND METHOD

[75] Inventors: Anthony T. Genova, Bolton; Vincent Squitieri, Billerica, both of Mass.; William G. Lionetta, Jr., Hampton, N.H.

[73] Assignee: Chomerics, Inc., Woburn, Mass.

[21] Appl. No.: 390,547

[22] Filed: Jun. 21, 1982

[51] Int. Cl.[3] ..... H01R 13/648; H01R 13/658

[52] U.S. Cl. ..... 339/143 R; 29/859; 339/DIG. 1; 339/DIG. 3

[58] Field of Search ..... 339/143, DIG. 1–DIG. 3

[56] References Cited

U.S. PATENT DOCUMENTS 3,744,128 7/1973 Fisher et al. ..... 339/143 R X 4,345,811 8/1982 Volka ..... 339/17 F X

*Primary Examiner*—Eugene F. Desmond

*Attorney, Agent, or Firm*—Wolf, Greenfield & Sacks

[57] ABSTRACT

A shielded cable system having a connector, a shielded cable and an interface of a pressure sensitive adhesive electrically conductive performed insert which provides effective noise suppression between the connector and cable. In manufacture the insert is folded about and positioned in contact with the connector and the cable suppression sheath (usually a metal braid) is then preferably held in good electrical contact with the connector and sheath by a shrinkable molded outer protective portion e.g. of dielectric material.

7 Claims, 13 Drawing Figures

FIG. 2
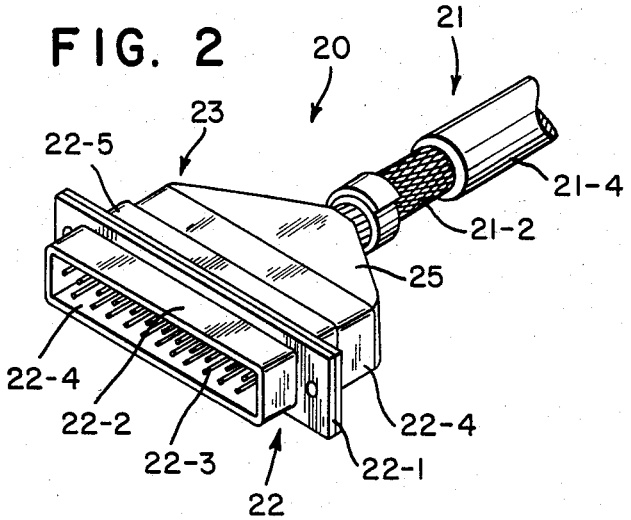
FIG. 3
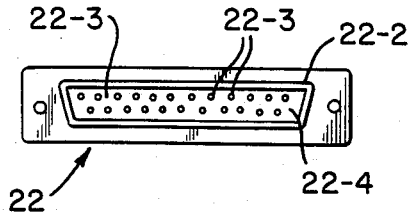
FIG. 6
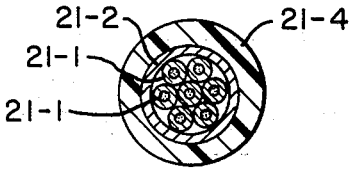
FIG. 4
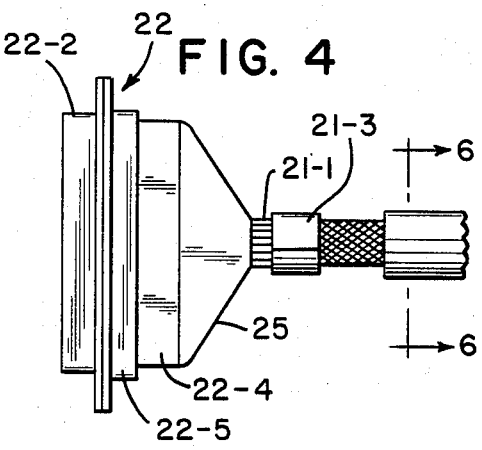
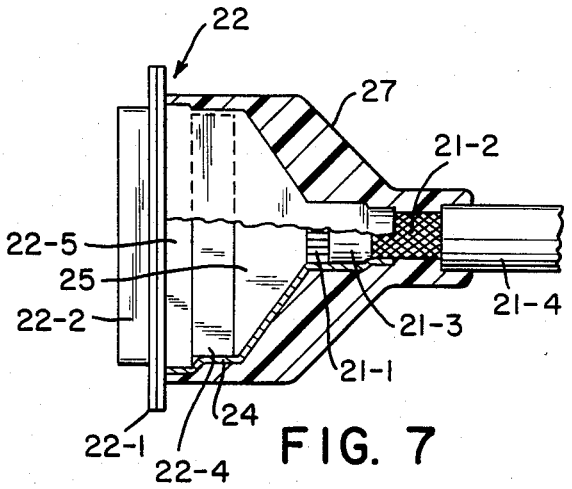
FIG. 7
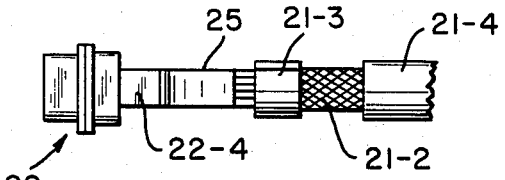
FIG. 5
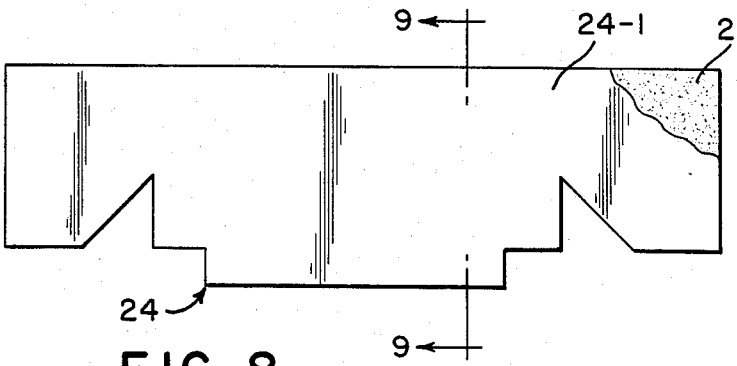
FIG. 8
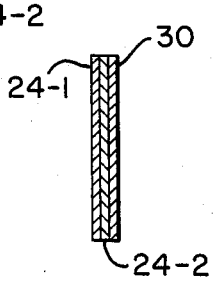
FIG. 9

SHIELDED CABLE SYSTEM AND METHOD

BACKGROUND OF THE INVENTION

This invention relates to shield and cable terminations and in particular the interface between connectors and cables.

This invention is particularly concerned with connectors and cables used with computers and data processing equipment, such as data terminals, modems, CRT displays, data printers, multiplexers and memory systems, test instrumentation, telecommuncations equipment and aerospace and avionic systems.

Under regulations promulgated by various governmental agencies, e.g. Federal Communications Commission (FCC) it is now a requirement that noise (radio frequencing and other emissions in the 20 to 200 Mega-Hertz range) from equipment be below certain levels.

Accordingly, manufacturers of electrical equipment are now very sensitive to any noise leakage from their equipment since they may not be able to sell to the public. Interconnecting cable systems (cable & terminating connectors) between equipment of an electronic system are obviously one source of potential emissions. With experience it has been determined that cables should be shielded to insure a low degree of noise emissions. Typically, cables are shielded using a metal braided sleeve or a metal filled plastic layer supported by a plastic tube (shrinkable or non-shrinkable). However, it has been found that multipin connectors, e.g. D type end panel connectors, where connected to cable must also be shielded in order to cut down on emissions. One way of conventionally attempting to meet the required reduction in connector-cable interface emissions is the soldering of a drain wire between the braided cable shield and the metal connector frame. However, this has not been found to provide sufficient emission reduction.

Another way of providing the attenuation desired at the connector cable interface has been the use of a pressure sensitive adhesive copper conductive tape, e.g., produced by 3M which is wrapped and then soldered to the metal braid of the cable. The 3M tape appears to be copper particles in an adhesive supported by a copper foil. While this will produce the normally desired emission supression results, and is a vast improvement over the soldered drain wire technique, manufacturing costs are high because (1) the method of manufacture is labor intensive and (2) there is a high rejection rate (as much as 30%) as reported by one manufacturer, as cables are destroyed curing manufacture e.g., a careless person soldering will frequently penetrate with a soldering iron the metal braid and injure the cable conductor wires. It has also been found that with copper particle tape, oxidation of the particles occurs rapidly if exposed to the air and thus the once conductive adhesive becomes ineffective as a conductor.

In order to more consistently meet the attentuation (noise suppression) achievable using the soldered copper tape at much lower costs, the present invention provides a new and improved cable-connector interface shielding system which lends itself readily to manufacture.

The new shielding system does not require soldering and thus labor costs and rejections are considerably reduced. It has been estimated, by a cable manufacturer that manufacturing costs on a ten foot shield cable normally selling for $18 to $20 will decrease by a dollar or more. Thus with a cable manufacturer making 3000 cables per week, it is estimated that annual savings will be about $150,000 or more. Obviously, if the entire industry were to adopt the system of this invention savings could easily be in the millions per year.

BRIEF SUMMARY OF THE DISCLOSURE

The improved cable system of this invention is made according to this invention by using a preformed electrically conductive pressure sensitive adhesive insert which is adapted to be folded about a metal portion of the connector and a electrical conductive sheath (sleeve) e.g. metal braided cable shield. Thereafter a molded encapsulating portion e.g. plastic is formed about the insert and when hardening shrinks slightly causing the insert to make a good electrical connection with the connector and the metal braid.

With the use of this manufacturing technique, soldering is no longer necessary since good electrical contact is achieved because of the interaction between the combination of parts used. The cable system formed with this invention provides highly effective noise suppression.

BRIEF DESCRIPTION OF THE DRAWINGS

FIG. 2 is a perspective view showing the cable and connector of FIG. 1 with encapsulating portion removed to expose the interior.

FIG. 3 is a front view of the connector of FIG. 1;

FIG. 4 is a top plan view of the cable and connector of FIG. 2;

FIG. 5 is a side view of the cable and connector of FIG. 2;

FIG. 6 is an enlarged sectional view taken along line 6—6 of FIG. 4;

FIG. 7 is a partial sectional top plan view of the cable and connector of FIG. 1;

FIG. 8 is a top view of the electrically conductive insert used in providing noise suppression with parts broken away.

FIG. 9 is a sectional view taken along line 9—9 in FIG. 8;

DETAILED DESCRIPTION OF THE DISCLOSURE

Figure 1:
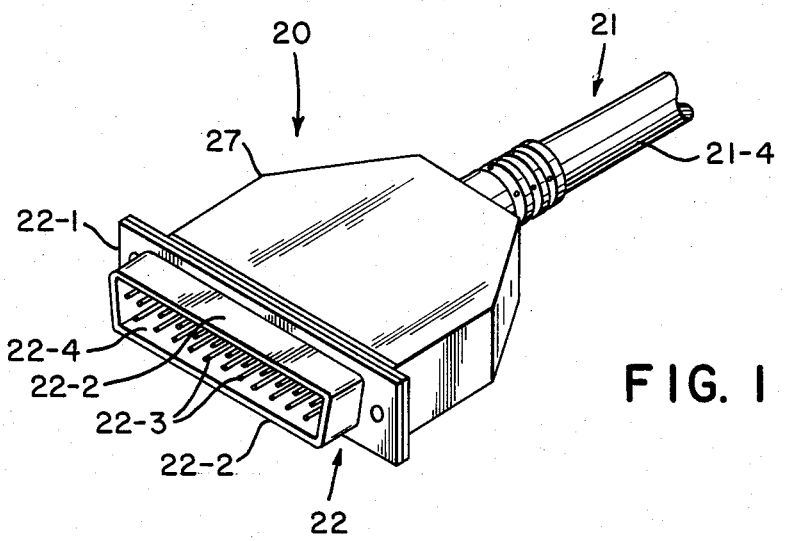
FIG. 1 is a perspective view showing a cable system including a cable and connector of this invention.

Reference should now be had to FIGS. 1 to 13 for a description of the preferred embodiment of the invention. In these figures the cable system 20 comprises a cable 21 and connector 22. The cable is of a conventional type having a plurality of insulated wires 21-1, each wire 21-1 includes a central conductor, copper, Al, etc. and one or more plastic insulator (dielectric) layer, e.g., polyethylene, polyester, polymide, polyvinyl chloride e.g., see U.S. Pat. Nos. 3,168,417 and 3,303,270. Since the nature of each wire 21-1 is not material to the present invention, it will not be further discussed. The wires 21-1 are supported in a conventional braided metal sheath 21-2 (casing, sleeve) which provides noise suppression at frequencies of between 20 to 200 mega-Hertz.

Over the sheath 21-2 is an outer protective dielectric layer 21-4, e.g. of polyethylene, polyester, and nylon, etc. as is conventional in the cable art.

The connector 22 shown is what is ordinarily called a "D" type and comprises a flat metal portion 22-1 with holes for bolting to a mating connector (plug). Extending outwardly from the flat portion is a hollow metal shell or sleeve 22-2 encasing metal pins 22-3 e.g. 25 or more etc. supported in an insulator potting composition 22-4 e.g. glass filled nylon, etc. Extending from the rear of the connector is another metal shell 22-5. It should be noted that the insulator potting 22-4 extends into the front sleeve 22-2 through the rear sleeve 22-5 and beyond it. (See FIGS. 4 and 7). The wires 21-1 are soldered to the rear of the pins extending beyond the potting composition 22-4 as is conventional.

Between the connector and cable there is an interface section 23 which provides noise suppression. This interface comprises a preformed insert 24 (See FIG. 8) of a metal foil 24-1 e.g. copper having metal particle filled electrically conductive pressure sensitive adhesive layer 24-2. In order to facilitate the coupling of pressure sensitive layer 24-2 to the metal connector portion 22-5 and the cable metal braid 21-4, there is provided a dielectric molded portion 25 e.g. plastic e.g. nylon, polyethylene, etc., which provides a sloping transition from the portion 22-4 to the cable wires 21-1. The cable wires 21-1 are preferably held together by a crimped metal band e.g. copper 21-3. In manufacture, the insert 24 with the cut-outs as shown is folded about the portions 22-5, 26 and 21-4 so that it is electrically coupled to the metal connector shell 22-5 and the metal braid 21-4. The insert when folded preferably forms an overlapping seal with itself. (See FIGs. 10 to 13) In order to hold the electrically pressure sensitive conductive adhesive 24-2 in good contact, with the connector and braid, a plastic outer casing 27 is molded over the insert and extends over the braid 21-2 and the connector portion 22-5 and abuts the rear of the connector portion 22-1. Preferably the insert 24 is crimped over the braid 21-2 (See FIG. 13).

In molding the interface portion 27, a liquid plastic e.g., nylon, polyethylene, preferably polyvinylchloride is used. Upon hardening (cooling) portion 27 sufficiently shrinks and hold (urges) the insert electrically conductive adhesive 24-1 over the braid 21-4 and connector portion 22-5 so that the continuous pressure is applied and thus good electrical contact is made between the particle filled adhesive 24-1 and the metal of the connector and braid.

In practice, it has been found that the insert 24 may comprise about a 0.5 to 5 mil thickness of copper foil which has a pressure sensitive adhesive electrical conductive coating of about 0.5 to 5 mil of polymer, such as acrylic, rubber, silicone, polyester, etc. filled with electrically conductive particles which do not readily form an oxide layer on the outside surface thereof. Since copper and aluminum by themselves readily oxidize and become non-conductive these are not considered as being particles which do not readily form an oxide layer. Conductive particles which are acceptable in its invention include silver, silver coated aluminum, silver coated copper, silver coated glass and nickel with or without a silver coating.

The preferred conductive pressure adhesive composition comprises a mixture of 100 grams Bostic (USM Corporation) 7518 adhesive (40% solids) 18 grams—silver plated copper particles—200 mesh (3 mil average size) available as Chomerics 8010, Chomerics, Inc. Woburn, Mass. In place of silver plated copper, nickel 287 particles (INCO) may be used in a like amount.

The preferred preformed insert 24 comprises a 2 mil foil and a 2 mil electrically conductive adhesive coating. The volume percent of conductive particles is 1 to 30%, and most preferably 4 to 10% by volume based on the total of adhesive (solids) and particles. The particles are preferably of an average particle size of 1 to 5 mils.

Figure 10:
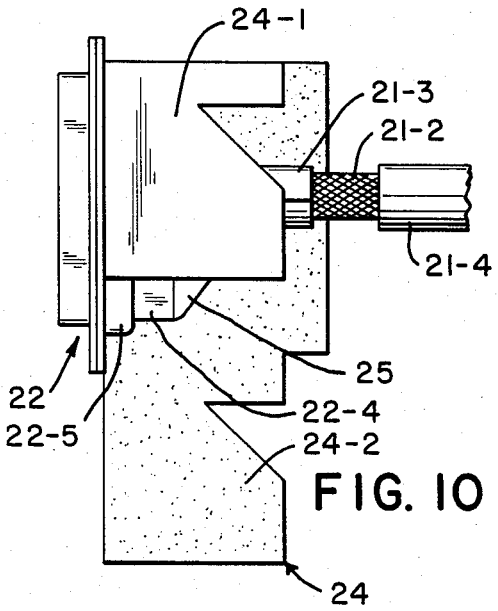
FIG. 10 is a top view illustrating folding of the conductive insert of FIGS. 9 and 10 over the cable and connector of FIG. 2.
Figure 11:
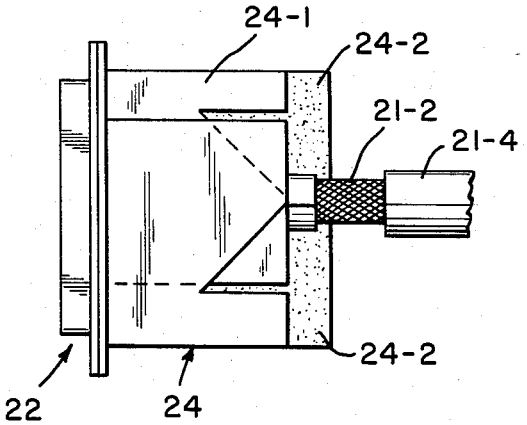
FIG. 11 is the same as FIG. 10 showing the second fold step of the insert.
Figure 12:
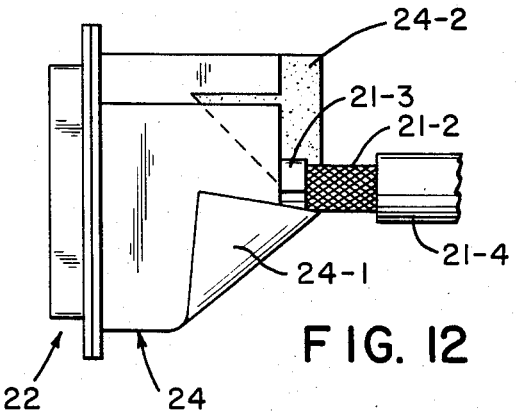
FIG. 12 is the same as FIGS. 10 and 11 showing the third step in folding of the conductive insert.
Figure 13:
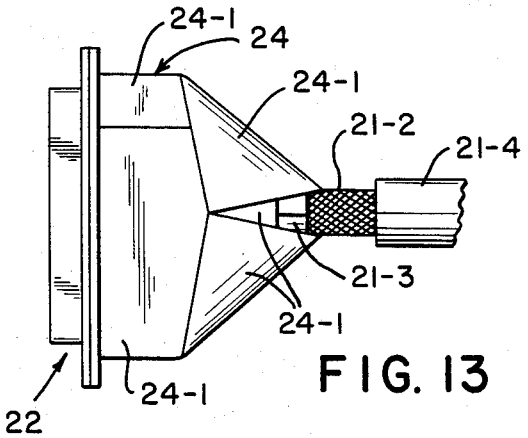
FIG. 13 is the same as FIGS. 10, 11 and 12 with the conductive insert fully folded about the braid and the connector.

The insert as a sheet is then die cut in the form shown in FIGS. 8 and 9 for folding over the connector and metal braid. FIGS. 10 to 11 illustrate the steps in folding the insert about the connector 22 portion 22-5 and the braided portion 21-4 after removing release paper 30 (e.g. stick not paper) covering the conductive adhesive of the insert (See FIG. 9). FIG. 8 shows the insert having preformed shape to facilitate folding over a wider connector portion 22-5 as well as a small diameter (width) braid 21-2.

The pressure sensitive adhesive of the insert 24 holds the insert 24 in place upon application to the connector and braid to permit the molded part 27 to be applied and also holds the conductive particles uniformly distributed across the insert contacting surfaces with the connector and braid.

We claim:

1. A cable system comprising a connector having a plurality of pins supported in an insulator which is itself supported in a metal portion, a cable having a plurality of wires in an electrically conductive cable shield, said wires coupled to said pins, a thin preformed electrically conductive, conductive particle loaded pressure sensitive adhesive carrying insert folded at predetermined fold lines and positioned about a metal portion of the connector and the electrically conductive cable shield acting as an enclosing extension of said shield with the adhesive of said insert in contact with said connector and said shield and means over said insert for urging said adhesive portion of said insert against said connector and said shield to aid in electrical contact therewith.

2. The system of claim 1 in which said insert comprises a metal foil coupled to an adhesive layer comprising a polymer and an electrically conductive particles.

3. The system of claim 1 or 2 in which the cable shield is metal braid, and said particles are selected from the class consisting of silver, silver coated aluminum, silver coated copper, silver coated glass, nickel and silver coated nickel.

4. The system of claim 2 in which said particles have an average size greater than the thickness of the polymer.

5. The system of claim 1, 2 or 4 in which there is provided a dielectric insulator over the wires between said connector and said cable shield which acts as a support for the insert.

6. The system of claim 1 in which said means for urging is a plastic which shrinks upon cooling.

7. The method of making a shield cable system comprising wrapping and folding along predetermined lines a preformed electrically conductive pressure sensitive adhesive insert about a metal portion of the connector and a shield of a cable with the adhesive in contact therewith and forming shrinkable means about said insert to insure good electrical conductivity between said connector and said cable shield, said insert comprising a metal foil coupled to an adhesive layer comprising a polymer and electrically conductive particles, said insert being folded at predetermined fold lines to act as an enclosing extension of said shield tightly held in good electrical contact with said connector and said cable shield.

* * * * *